US009186011B2

(12) United States Patent
Buckingham

(10) Patent No.: US 9,186,011 B2
(45) Date of Patent: Nov. 17, 2015

(54) BRA ASSISTIVE DEVICE

(71) Applicant: Christine Buckingham, Milborne St Andrew (GB)

(72) Inventor: Christine Buckingham, Milborne St Andrew (GB)

( * ) Notice: Subject to any disclaimer, the term of this patent is extended or adjusted under 35 U.S.C. 154(b) by 0 days.

(21) Appl. No.: 14/200,385

(22) Filed: Mar. 7, 2014

(65) Prior Publication Data

US 2014/0252050 A1 Sep. 11, 2014

(51) Int. Cl.
*A47G 25/90* (2006.01)
*A41C 3/00* (2006.01)

(52) U.S. Cl.
CPC .. *A47G 25/90* (2013.01); *A41C 3/00* (2013.01)

(58) Field of Classification Search
CPC ..... A47G 25/80; A47G 25/90; A41C 3/00; A41C 3/0028
USPC ..... 223/111–113; 128/869; 450/77
See application file for complete search history.

(56) References Cited

U.S. PATENT DOCUMENTS 3,302,649 A * 2/1967 Enrico ..... 450/63
3,327,361 A * 6/1967 Mathison ..... 24/198
3,568,901 A * 3/1971 McNitt ..... 223/111
4,300,568 A 11/1981 Blanckmeister
4,325,378 A * 4/1982 Wilkinson ..... 450/77
5,032,104 A * 7/1991 Rainville ..... 450/58
6,319,091 B1 * 11/2001 Kilbride et al. ..... 450/17
2009/0039118 A1 * 2/2009 Whitlaw ..... 223/111
2010/0078450 A1 * 4/2010 Longhurst ..... 223/111

FOREIGN PATENT DOCUMENTS

DE 283730 4/1915
JP 2007209723 8/2007

* cited by examiner

*Primary Examiner* — Ismael Izaguirre
(74) *Attorney, Agent, or Firm* — Daniel Boudwin; Global Intellectual Property Agency LLC

(57) ABSTRACT

A bra assistive device is provided. The present invention allows disabled individuals who lack the use of one of their arms to put a bra on in a convenient and efficient manner. The present invention consists of a base that is designed to be secured between an individual's knees or thighs, a shaft extending from the base, a first connector integrally affixed to the shaft, a second connector removably positioned on the shaft, and an adjustable strap having a first end and a second end connected to the second connector. The present invention allows individuals who only have a single operative arm to clasp the opposing ends of a bra strap together, which generally requires two operative arms, and thereby put a bra on.

17 Claims, 6 Drawing Sheets

BRA ASSISTIVE DEVICE

CROSS REFERENCE TO RELATED APPLICATION

This application claims the benefit of UK Patent Application No. GB1304102.5 filed on Mar. 7, 2013. The above identified patent application is herein incorporated by reference in its entirety to provide continuity of disclosure.

BACKGROUND OF THE INVENTION

1. Field of the Invention

The present invention relates to bra accessories. More specifically, the present invention relates to aids for assisting users in putting a bra on.

Putting on a conventional bra is a very onerous task for women who lack the ability to fully use one of their arms. Conventional bras are designed to be put on by the user reaching behind her back and clasping the ends of the back bra strap together using both arms simultaneously. This design makes conventional bras very difficult to use for women who cannot use both of their arms because the clasping mechanism was not designed with their handicap in mind.

Some bras attempt to address these issues by having an extra strap or cord attached to a portion of the bra, which helps women with one arm position the opposing side of the bra that they are otherwise unable to reach. However, this forces these women to only purchase this specific type of bra. Bras designed to be put on using only one hand is a relatively niche market, thus women forced to use these types of bras have fewer options available to them. Therefore, there is a need in the prior art for a bra assistive device that allows users who have only one arm or who otherwise lack the requisite level of dexterity in one arm to put on a conventional bra.

A device for assisting users in putting on conventional bras using only one hand is provided. The present invention comprises a base portion that can be secured between a user's knees or thighs for additional support, an elongated shaft portion supporting an integrally-attached first connector and a strap adjuster portion, and a strap extending through the strap adjuster and connected at one end to a second connector. The device is used by securing one of the free ends of the bra strap in each of the connectors. The second connector, along with the free end of the bra strap secured by that connector, is disconnected and the user then uses his operative arm to place the strap over her head and around her opposing shoulder and arm so that the bra is positioned behind the user around her waist. In this position, the bra clasp is situated directly in front of the user. The user can then grasp the free end of the bra strap held by the second connector and clasp it with the opposing free end of the bra strap, which is conveniently held securely in position before the user by the first connector. Once the two free ends of the bra strap are connected together, the bra can then be rotated about the user's torso and pulled up in position by the user. The present invention thereby provides a simple and convenient means for clasping a bra for users that only have the use of one of their arms.

2. Description of the Prior Art

Devices have been disclosed in the prior art that relate to clothing or clothing accessories designed for disabled individuals. These include devices that have been patented and published in patent application publications. These devices generally relate to articles of clothing that have cords, allowing them to be more easily pulled into position. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 4,300,568 to Blanckmeister, which discloses a therapeutic bra designed to be easily put on by partially disabled individuals. Blanckmeister comprises a standard bra design with a draw tape detachably connected to the bra's back strap. Blanckmeister provides a bra that can be put on without the individual having to reach beyond her back and requires only a minimal amount of dexterity to use. The present invention, on the other hand, provides a stand that can be used to put any type of bra on and does not restrict the user to the specific type of bra disclosed in Blanckmeister.

Another such device is JP 2007209723 to Iwahara, which discloses a detachable aid for putting on socks, comprising a pair of straps that have clips disposed at one end and are attached to a handle at the other end. The present invention also utilizes a strap that has a detachable connector at one end, but the strap of the present invention is adjustable and the present invention further utilizes a base to which the user can apply her to weight to for further assistance in putting her bra on.

DE 283730 to Retzlaff further discloses a strap having a removable connector and a cord, but as with Iwahara, it fails to disclose a base portion and is not adapted for use with a bra.

The present invention provides a bra assistive device that aids users who only have the use of one of their arms in putting a conventional bra on. The present invention can be used with any type of bra and does not require that users alter their bras in any way or purchase a specific type of non-conventional bra. The present bra assistive device comprises a base portion that has a contour or contours adapted to receive a user's knees or thighs, a shaft portion extending therefrom, a first connector integrally attached to a vertical position on the shaft, a strap adjuster, a strap extending through the strap adjuster, and a second connector disposed at one of the ends of the strap. Furthermore, an overlay is preferably disposed on the strap adjacent to the second connector. The overlay is designed to hold the second connector in an upright position against the shaft when the strap is pulled through the strap adjuster up to the edge of the overlay. The connectors are designed to accept opposing free ends of a bra strap. The second connector is removable from the shaft, allowing the portion of the bra connected to it to be positioned around the user's back while the other portion of the bra strap is held in place by the first connector. Once the second connector is in position, the free end of the strap held within the second connector can then be secured to the opposing free end of the bra strap, which is conveniently held before the user by the first connector. Once the opposing free ends of the bra strap are connected together, the bra can then be repositioned as normal. The present invention may further comprise a recessed portion disposed at the top of the base portion for holding the strap component when not in use. The present invention substantially diverges in design elements from the prior art and consequently it is clear that there is a need in the art for an improvement to existing clothing assistive devices. In this regard the instant invention substantially fulfills these needs.

SUMMARY OF THE INVENTION

In view of the foregoing disadvantages inherent in the known types of clothing assistive devices now present in the prior art, the present invention provides a new bra assistive device wherein the same can be utilized for providing convenience for the user when putting a bra on using only a single arm or hand.

It is therefore an object of the present invention to provide a new and improved bra assistive device that has all of the advantages of the prior art and none of the disadvantages.

It is another object of the present invention to provide a bra assistive device that allows the user to put a bra on using only one hand in a more efficient manner.

Another object of the present invention is to provide a bra assistive device that can be used with any type of bra.

Another object of the present invention is to provide a bra assistive device that can be secured against the user.

Yet another object of the present invention is to provide a bra assistive device that has a means for storing the strap component when in not use.

Yet another object of the present invention is to provide a bra assistive device that has an adjustable strap.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
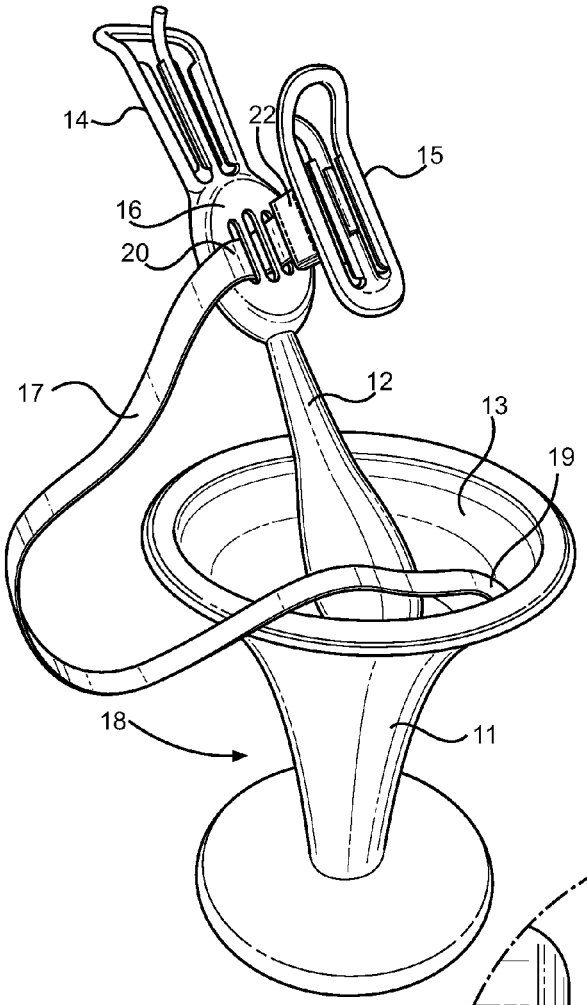
FIG. 1 shows a perspective view of the present invention.

Reference is made herein to the attached drawings. Like reference numerals are used throughout the drawings to depict like or similar elements of the bra assistive device. For the purposes of presenting a brief and clear description of the present invention, the preferred embodiment will be discussed as used for putting a bra on with one hand. The figures are intended for representative purposes only and should not be considered to be limiting in any respect.

Figure 1A:
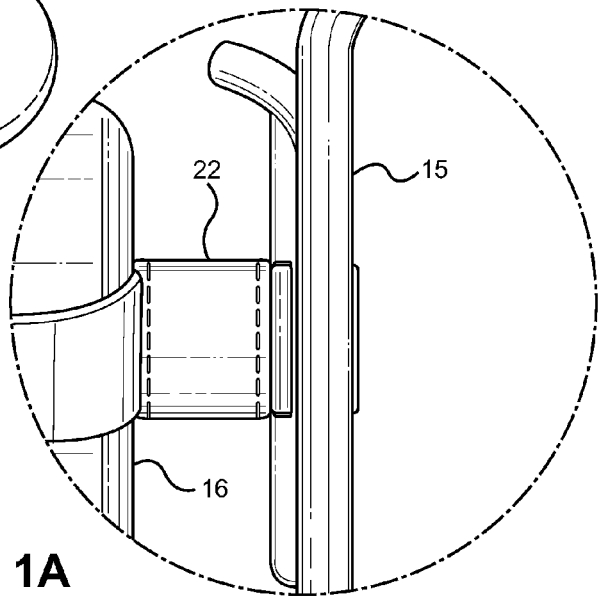
FIG. 1A shows a side view of the overlay component of the present invention.
Figure 2:
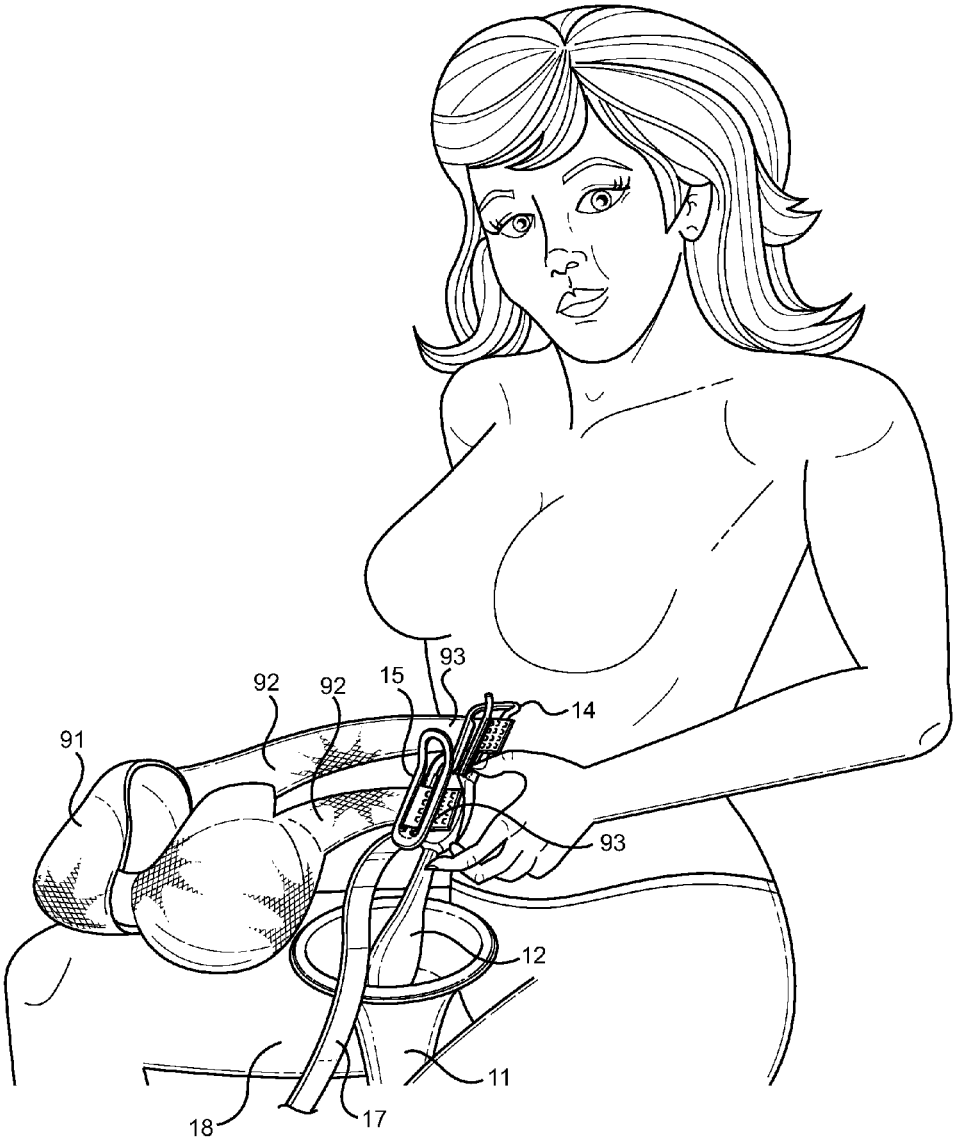
FIG. 2 shows a perspective view of the present invention in use.
Figure 3:
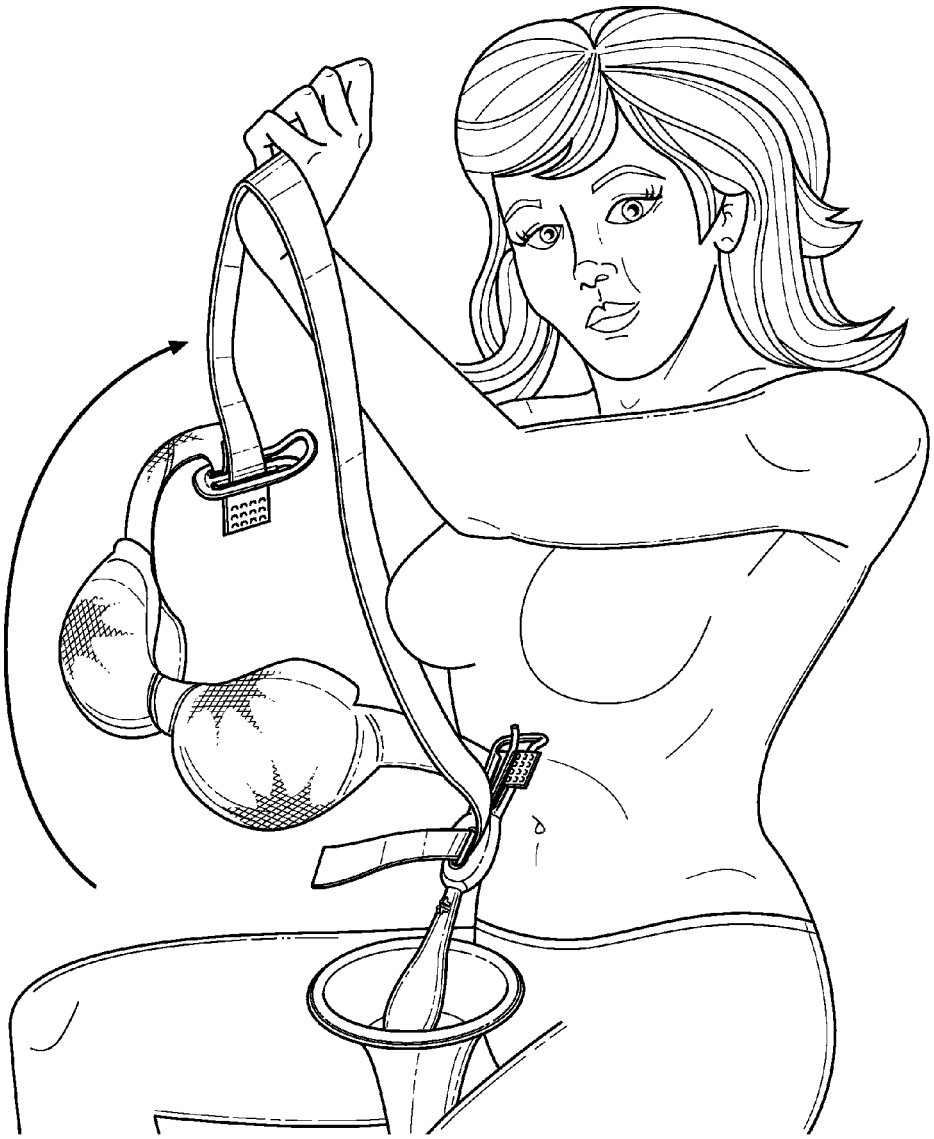
FIG. 3 shows a perspective view of the present invention in use.
Figure 4:
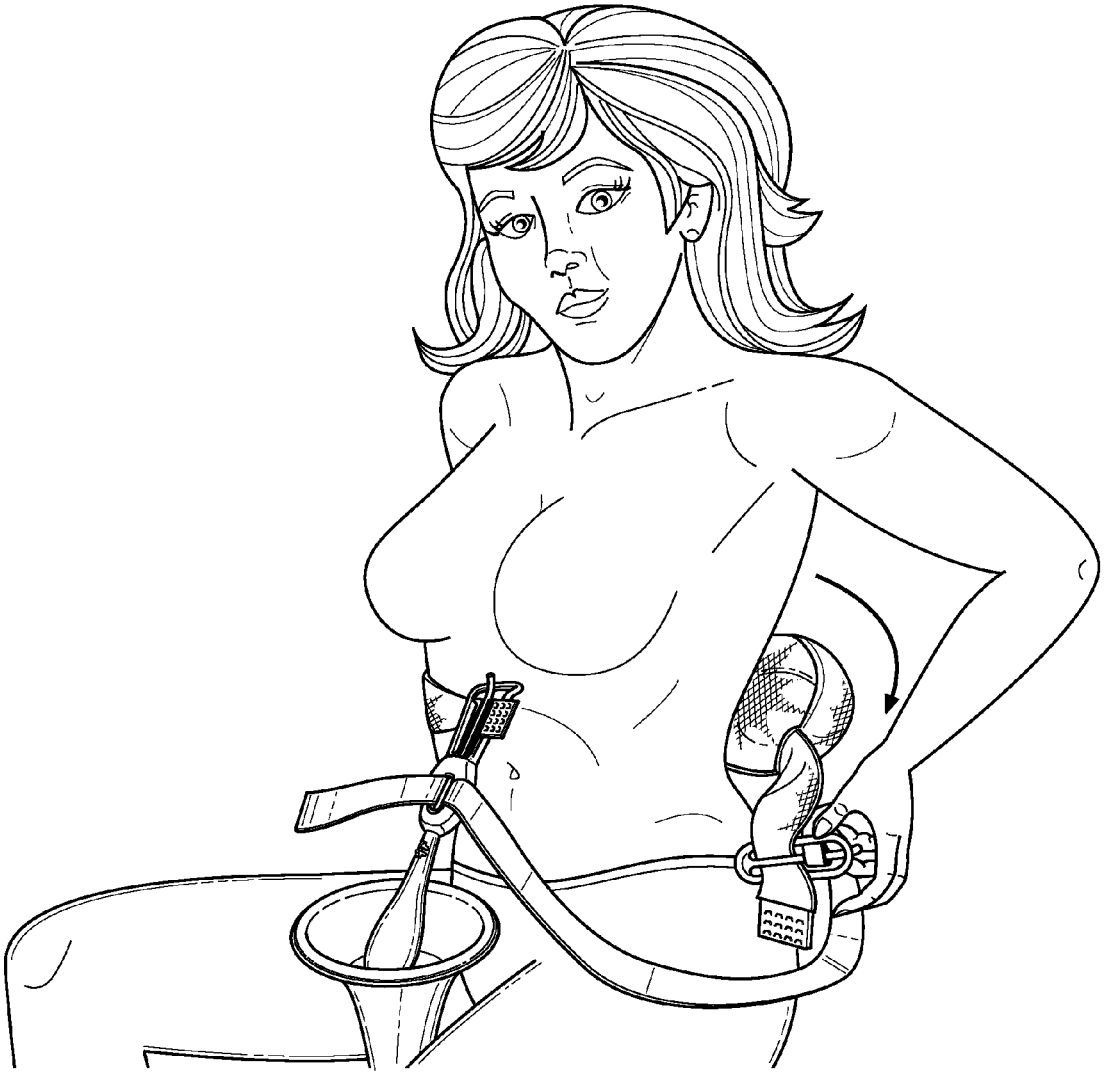
FIG. 4 shows a perspective view of the present invention in use.
Figure 5:
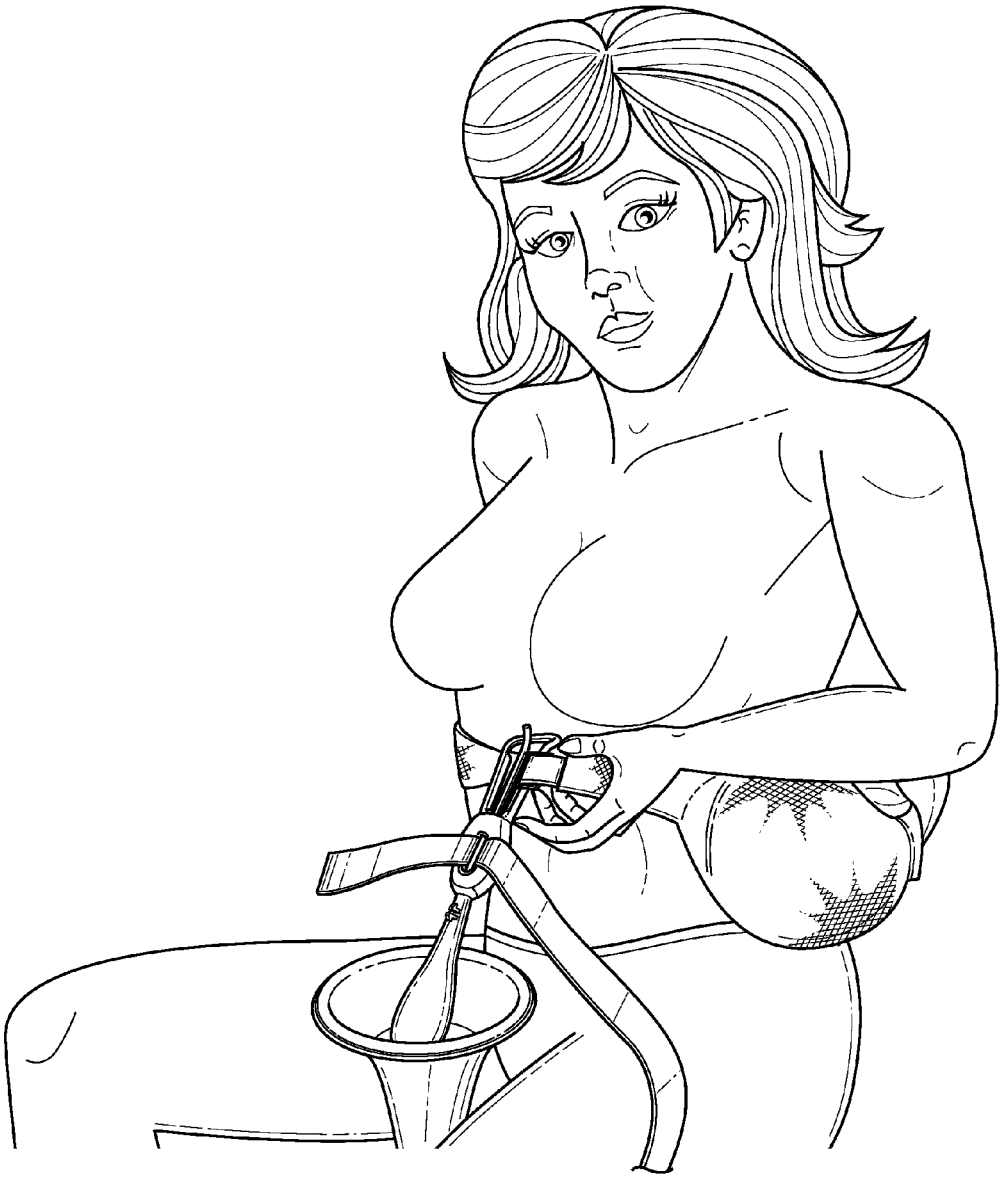
FIG. 5 shows a perspective view of the present invention in use.

Referring now to FIGS. 1 and 1A, there are shown a perspective view of the present invention and a side view of the overlay component of the present invention. The present bra assistive device comprises a base 11, a shaft 12, a strap 17, a strap adjuster 16, and a pair of connectors 14, 15 disposed on the shaft 12. The base 11 further comprises a top portion from which the shaft 12 extends and a substantially level bottom portion suitable for supporting the present invention on the ground in a stable manner. A recess 13 is preferably disposed on the top portion of the base 11, below the shaft 12, and acts as a means for storing the strap 17 when not in use. The base 11 further includes at least one indentation 18 disposed between its top and bottom portions. The indentation 18 is contoured so that users can place the base 11 between their knees or thighs, thereby bearing their weight against the base 11 and holding the present invention securely in place when in use. As depicted, the indentation 18 is disposed all about the vertical axis of the base 11, generating an inverted conically-shaped base 11 having a flat disc portion on the bottom and a circular, curved lip portion at the top. However, no claim is made as to the exact design of the indentation 18. Other embodiments are contemplated in which there are multiple indentations suitable for a user to place her knees or thighs against, such as a shallow impression on each of the opposing sides of the base 11.

The shaft 12 has a first end connected to the base 11 and a second end with a first connector 14 and a second connector 15 disposed thereon. The shaft 12 extends vertically from the recess 13 within the base 11, holding the connectors 14, 15 in a raised position so that they can be manipulated by users. The first and second connector 14, 15 are preferably situated such that they are adjacent or in close proximity to each other so that a user can easily secure both of the free ends of the bra strap to the present invention without a significant amount of effort. The first connector 14 is integrally connected to the shaft 12 and the second connector 15 is removably disposed adjacently to the shaft 12. As depicted, the connectors 14, 15 comprise clips having an elliptical or rectangular ring with a retaining arm disposed thereacross. The retaining arm is biased such that the free end of the retaining arm frictionally engages against the opposing edge of the elliptical or rectangular ring. However, the connectors 14, 15 may comprise any type of clips, clasps, hook-and-loop fastener material, or any other type of temporary holders known in the prior art.

The second connector 15 is held in position against the shaft via an overlay 22, which is disposed on the strap 17, between the strap adjuster 16 and the second connector 15. The overlay 22 is composed of stiff material that is capable of holding the second connector 15 in an upright position when it is pulled against the strap adjuster 16. The overlay 22 preferably comprises a thickened portion of strap 17 material that is stitched to said strap 17 or affixed to said strap 17 via a rivet. However, no claim is made as to the specific means for fastening the overlay 22 to the strap 17. Furthermore, no claim is made as to the specification composition or configuration of the overlay 22, except insofar as that it cannot be pulled through the strap adjuster 16 and it is a thickened, stiff portion of the strap 17 that is adapted to hold the second connector 15 in an upright position when the strap 17 is pulled through the strap adjuster 16 up to the edge of the overlay 22.

The strap 17 is threaded through a strap adjuster 16, which is disposed on the shaft 12. The strap adjuster 16 preferably comprises a ring or other open aperture with a retaining member disposed across. It is submitted that this type of strap adjuster 16 is well known in the prior art. The strap 17 has a first end 19 and a second end 20 affixed to the second connector 15. The first end 19 may be either free such that it can be gripped by a user so that the strap 17 can be pulled through the strap adjuster 16 or it may be integrally connected to the base 11 portion, as depicted. The strap 17 thereby tethers the second connector 15 to the present invention when the second connector 15 is detached from its secured position on the shaft 12. The strap 17 is preferably composed of flexible elastic material.

In an alternative embodiment of the present invention, the shaft 12 is pivotally mounted to the base 11. This allows the user to adjust the position of the shaft 12 so that the free ends 93 of the bra strap 92 can be easily connected to and disconnected from the connectors 14, 15. It is important for the free ends 93 of the bra strap 92 to be positioned in a comfortable manner in front of the user because the device is designed to be used by individuals having only a single operative arm, thus the connectors 14, 15 must be easy to reach by the user at all times. Because the shaft 12 is disposed within the recess 13, it is able to rotate freely about the axis of the base 11 without interference.

Referring now to FIGS. 2-5, there are shown perspective views of various stages of the present invention in use. The present invention is designed to allow disabled individuals who lack the use of one arm to put a bra 91 on in a convenient manner. When in use, the user preferably places her knees or thighs in the depressions 18 around the base 11, thereby allowing the user to bear her weight against the base 11. The user can either hold the present invention in place by squeezing the base 11 between her knees or thighs, or the user can lean against a bottom portion of the base 11 to hold the present invention against the floor. This prevents the present bra assistive device from moving when in use.

The user then secures each of the free ends 93 of the bra strap 92 to one of the connectors 14, 15. Once both free ends 93 are secured, the user then detaches the second connector 15 and pulls the strap 17 until there is sufficient slack such that the strap 17 and the bra 91 can be placed around the user's head, shoulders, and opposing arm so that the bra 91 is positioned behind the user. The user is able to do this with one arm because the opposing bra strap free end 93 is securely held in place by the first connector 14 of the present invention. Once the bra 91 is positioned behind the user, the user can then pull in the excess slack in the strap 17, bringing the bra 91 against the user's back. Because the opposing free end 93 is held in place directly in front of the user by the first connector 14 disposed at the end of the elongated shaft 12, the user can then clasp the free ends together 93 using a single hand, rotate the bra around the her torso, and then lift and straighten the bra 91 into position.

Figure 6:
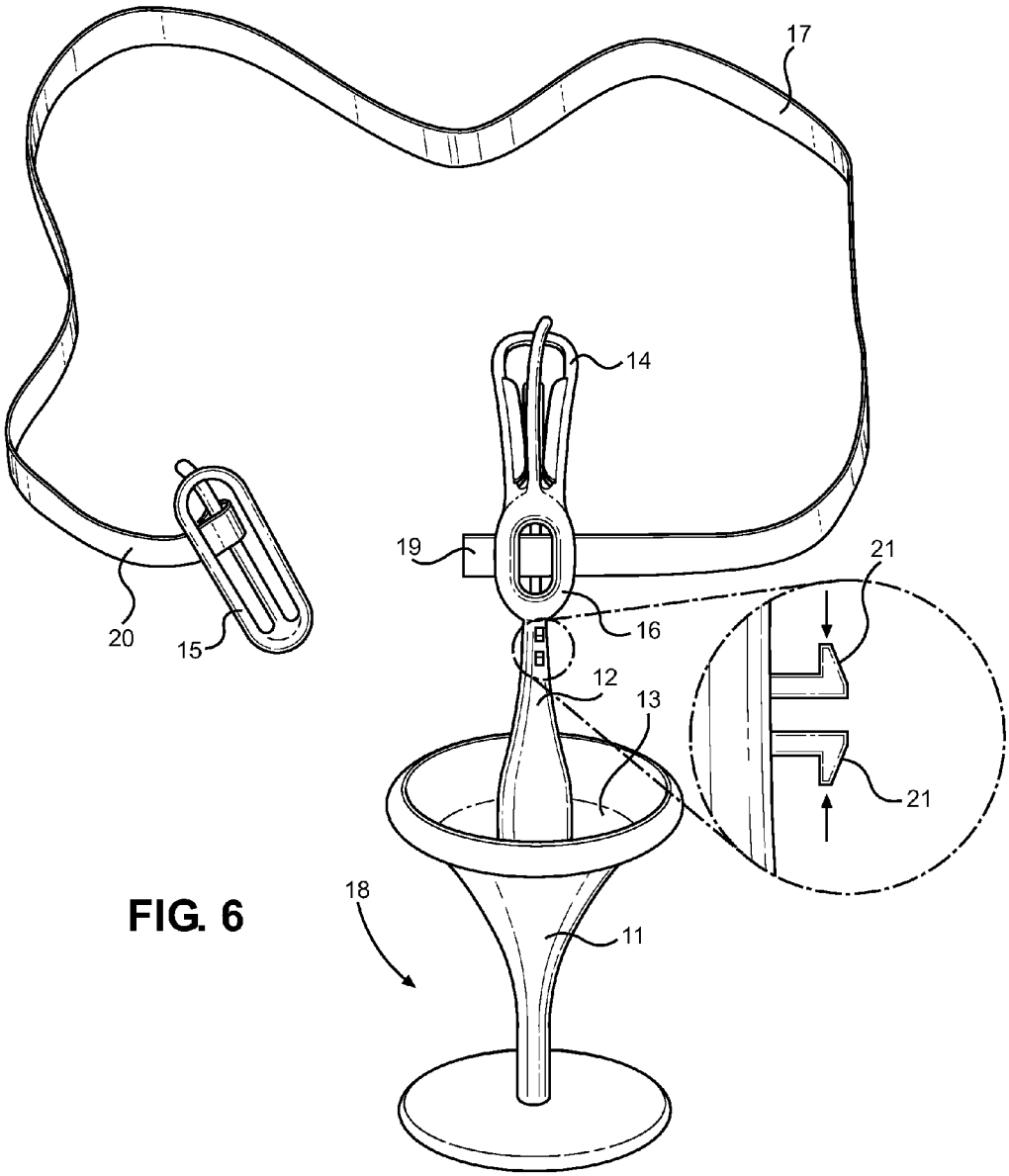
FIG. 6 shows a perspective view of an alternative embodiment of the present invention.

Referring now to FIG. 6, there is shown an alternative embodiment of the present invention. In this alternative embodiment, the second connector 15 is removably affixed to the shaft 12 via a removable attachment 21, rather than held in position by an overlay disposed on the strap 17 when the strap 17 is tightened. As depicted, the removable attachment 21 is a depressible tab mechanism comprising a pair of tabs having flanges extending therefrom that engage with complementary recesses disposed on the second connector 15. When the second connector 15 is affixed to the shaft 12, the removable attachment 21 holds the second connector 15 securely in place. When the user wishes to remove the second connector 15 from the shaft 12, she simply squeezes the tabs to release them from the complementary recesses on the second connector 15 and withdraws the second connector 15 therefrom. It is submitted that this type of removable connection is commonly known in the prior art. However, no specific claim is made as to the specific means by which the second connector 15 is removably affixed to the shaft 12 and the removable connector may comprise any such means commonly known in the prior art, including clasps, clips, hook and loop fastener material, and other such removable attachments.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An assistive device for putting on a bra, comprising:
a base having a top portion and a bottom portion;
a shaft extending from said top portion of said base;
a first connector disposed on said shaft;
a strap adjuster disposed on said shaft;
a strap adjustably threaded through said strap adjuster, said strap having a first end and a second end affixed to a second connector;
an overlay disposed on said strap between said strap adjuster and said second connector.

2. The assistive device for putting on a bra of claim 1, wherein said overlay comprises stiff material adapted to secured said connector in an upright position when said strap is pulled through said strap adjuster to said overlay.

3. The assistive device for putting on a bra of claim 1, further comprising a recess disposed on said top portion of said base about said shaft.

4. The assistive device for putting on a bra of claim 1, further comprising at least one indentation disposed on said base.

5. The assistive device for putting on a bra of claim 1, further comprising a pair of opposing indentations disposed on said base.

6. The assistive device for putting on a bra of claim 1, wherein said first and second connector are clips, said clips comprising a ring with a retaining member disposed thereacross and biased against said ring.

7. The assistive device for putting on a bra of claim 1, wherein said shaft is pivotally attached to said top portion of said base.

8. The assistive device for putting on a bra of claim 1, wherein said bottom portion of said base comprises a flat disc adapted to rest flush against a surface.

9. The assistive device for putting on a bra of claim 1, wherein said base has an inverted conical shape.

10. The assistive device for putting on a bra of claim 1, wherein said strap is composed of flexible elastic material.

11. The assistive device for putting on a bra of claim 1, wherein said strap first end is free.

12. The assistive device for putting on a bra of claim 1, wherein said strap first end is affixed to said base.

13. An assistive device for putting on a bra, comprising:
a base having a top portion and a bottom portion;
a shaft extending from said top portion of said base;
a first connector disposed on said shaft;
a second connector removably disposed on said shaft;
a strap adjuster disposed on said shaft;
a strap adjustably threaded through said strap adjuster, said strap having a first end and a second end affixed to said second connector.

14. The assistive device for putting on a bra of claim 13, where said second connector is removably affixed to said shaft via a depressible tab mechanism disposed on said shaft.

15. The assistive device for putting on a bra of claim 13, wherein said first connector and said second connector are disposed adjacently to each other on said shaft.

16. A method of putting on a bra using a single arm, comprising:

removably securing a first bra strap free end to a first connector that is anchored in place;

removably securing a second bra strap free end to a second connector that is connected to said first connector via a strap;

passing said strap over a user's non-operative arm, head, and upper torso, thereby positioning said strap and said second connector behind the user;

pulling in the slack of said strap, thereby positioning said second connector and said bra strap free end next to the user;

removing said second bra strap free end from said second connector;

connecting said second bra strap free end and said first bra strap free end together;

removing said first bra strap free end from said first connector.

17. The method of putting on a bra using a single arm of claim 16, further comprising the steps of:

rotating the bra about the user's torso;

lifting the bra into position.

* * * * *